United States Patent [19]

Hauffe et al.

[11] 4,389,260

[45] Jun. 21, 1983

[54] COMPOSITION AND PROCESS FOR THE PHOSPHATIZING OF METALS

[75] Inventors: Dieter Hauffe, Frankfurt am Main; Gerhard Muller, Hanau am Main; Werner Rausch, Oberursel; Josef Rothkegel, Maintal; Gudrun Volling, Frankfurt am Main, all of Fed. Rep. of Germany

[73] Assignee: Occidental Chemical Corporation, Warren, Mich.

[21] Appl. No.: 337,916

[22] Filed: Jan. 8, 1982

[30] Foreign Application Priority Data

Jan. 22, 1981 [DE] Fed. Rep. of Germany ..... 3101866

[51] Int. Cl.[3] ..... C23F 7/08

[52] U.S. Cl. ..... 148/6.15 Z; 106/14.12; 106/14.15

[58] Field of Search ..... 148/6.15 Z; 106/14.12, 106/14.15, 14.21

[56] References Cited

U.S. PATENT DOCUMENTS

| | | | |
|---|---|---|---|
| 3,203,835 | 8/1965 | Blum | 148/6.15 Z |
| 3,533,859 | 10/1970 | Engesser et al. | 148/6.15 Z |
| 3,676,224 | 7/1972 | Snee | 148/6.15 Z |
| 3,810,792 | 5/1974 | Ries et al. | 148/6.15 Z |
| 4,003,761 | 1/1977 | Gotta et al. | 148/6.15 Z |
| 4,142,917 | 3/1979 | Yashiro et al. | 148/6.15 Z |

*Primary Examiner*—Lorenzo B. Hayes

*Attorney, Agent, or Firm*—Richard P. Mueller

[57] ABSTRACT

A composition for the phosphatizing of metals, particularly iron and steel, which comprises an aqueous acidic, chlorate-containing zinc phosphate solution which contains from 0.5 to 1.5 g/liter Zn
from 0.4 to 1.3 g/liter Ni
from 10 to 26 g/liter $P_2O_5$
from 0.8 to 5 g/liter $ClO_3$ and in which no nitrite is added, and in which the weight ratio of Zn to Ni shall be adjusted to a value of 1: (from 0.5 to 1.5), that of Zn to $P_2O_5$ to a value of 1: (from 8 to 85) and that of free $P_2O_5$ to a value of from (0.005 (at about 30 degrees C.) to 0.06 (at about 60 degrees C.)): 1.

The composition is particularly useful in processes for the preparation of metal surfaces for electrophoretic coating, particularly for cathodic immersion coating.

10 Claims, No Drawings

COMPOSITION AND PROCESS FOR THE PHOSPHATIZING OF METALS

The invention relates to a process for the phosphatising of metals, particularly iron and steel, with aqueous acidic chlorate-containing zinc phosphate solutions at temperatures of from 30 to 60 degrees C. as well as its application to the preparation of the metal surfaces for electrophoretic coating.

BACKGROUND OF THE INVENTION

West German Offenlegungsschrift (Unexamined Patent Application) No. 22 32 067 describes aqueous acidic phosphatising solutions, having a weight ratio of $Zn:PO_4=1$: (from 12 to 110), for the surface treatment of metals, particularly iron and steel. The reduced zinc content, in comparison with customary phosphatising baths, leads to improved thin and even phosphate coats, which have very good adhesion and stability and are eminently suitable as a foundation for the subsequent electrophoretic coating. It has proved very advantageous in this process to use nitrite in addition, for achieving the desired results.

West German Offenlegungsschrift No. 30 04 927 discloses a process for the phosphatising of metals that are subsequently electroplated, in which, similarly, acidic aqueous ainc phosphate solutions are employed. The solutions contain nitrite ions and/or aromatic nitrocompound as accelerators. The performance of the phosphatising operation takes place in a special dipping/spraying process.

The disadvantage of the known processes is that the preferably employed nitrite leads to the formation of nitrous gases, which, as is known, are toxic and malodorous. Extraction measures, therefore, are indispensable for ensuring works' safety.

It is, therefore, an object of the invention to provide a process, which does not possess the disadvantages of the known processes, requires little heating energy, owing to low application temperatures, and is easy to carry out.

This and other objects will become apparent to those in the art from the description of the invention which follows.

SUMMARY OF THE INVENTION

The problems of the prior art processes have been solved by the use of an aqueous, acidic chlorate-containing zinc phosphate solutions which contains:

from 0.5 to 1.5 g/liter Zn
from 0.4 to 1.3 g/liter Ni
from 10 to 26 g/liter $P_2O_5$
from 0.8 to 5 g/liter $ClO_3$ to which no nitrite is added and in which the weight ratio of Zn to Ni is adjusted to a value of 1: (from 0.5 to 1.5), that of Zn to $P_2O_5$ to a value of 1: (from 8 to 85) and that of free $P_2O_5$ to total $P_2O_5$ to a value of from (0.005 (at about 30 degrees C.) to 0.06 (at about 60 degrees C.)):1.

The process according to the invention is particularly intended for the treatment of iron and steel. It is however also suitable for the phosphatising of materials of zinc and aluminum, as well as for steel having coatings of zinc, zinc alloys, aluminum and aluminum alloys.

DETAILED DESCRIPTION OF THE INVENTION

The phosphating solutions of the present invention may be formulated from any suitable sources of zinc, phosphate, nickel and chlorate, as are well known in the art. For example, zinc and phosphate ions can be introduced in a conventinal manner by the use of compounds such as zinc nitrate, zinc oxide, zinc carbonate, zinc acid phosphate, phosphoric acid, monosodium phosphate, disodium phosphate, and the like. Chlorate ions can be introduced as the alkali metal salt, such as sodium chlorate, and the like, while the nickel may be added as any bath soluble nickel compound, such as nickel nitrate, and the like.

As noted above, the solutions will contain from 0.5 to 1.5 g/l Zn and preferably about 0.8 to 1.2 g/l Zn. The solutions will also contain from 0.4 to 1.3 g/l Ni and from 10 to 26 g/l $P_2O_5$. Additionally, they will contain from 0.8 to 5 g/l $ClO_3$ and preferably about 1 to 3 g/l $ClO_3$.

Within these concentration ranges, the weight ratio of Zn:Ni is maintained at a value of 1:0.5–1.5. Similarly, the weight ratio of $Zn:P_2O_5$ is maintained at a value of 1:8–85. It is important for the high quality of the phosphate coatings, produced by the process according to the invention, to maintain this concentration between Zn and $P_2O_5$. Similarly, it is important to maintain this concentration between Zn and Ni, as the addition of Nickel to the bath has a favorable effect on the phosphatising speed, the layer formation on steel surfaces that are relatively difficult to phosphatise and on zinc surfaces and on the anti-corrosive properties.

Furthermore, the ratio of free $P_2O_5$ to total $P_2O_5$ in the bath has to be kept at from (0.005 to 0.06):1, in order to produce uniformly covering phosphate layers. The phosphatising speed decreases at higher values; simultaneously, the quality of the phosphate layers is reduced. Failure to reach the values given leads to excessive precipitation of zinc phosphate sludge and is undesirable for this reason alone. Preferably, the weight ratio of free $P_2O_5$ to total $P_2O_5$ is adjusted to (from 0.005 to 0.003):1, especially (from 0.005 to 0.027):1 for the temperature range of 45–60 degrees C.

The low values of the ratio of free $P_2O_5$ to total $P_2O_5$ (acid ratio) within the range according to the invention apply to the lower bath temperatures, (low ratio $Zn/P_2O_5$ and low total concentration); the higher acid ratios refer to higher bath temperatures, (low ratios refer to higher bath temperatures, (higher ratios $Zn/P_2O_5$ and higher total concentrations). With the aid of these general indications about the function of the acid ratio, the optimum acid ratio for a given bath of the invention can be readily determined.

The following methods may be used for the determination of free and total $P_2O_5$,—see e.g. Rausch: The Phosphatising of Metals, Leuze Publishing Company, Saulgau, 1974, pages 274–277,:

Free $P_2O_5$:

Titrate 10 ml of bath solution to the turning point of the first $H_3PO_4$ stage with N/10 NaOH. 1 ml of N/10 NaOH consumed corresponds to 0.71 g of free $P_2O_5$.

Interference by hydrolysing zinc phosphate can be eliminated e.g. by addition of $K_3(Co(CH)_6)$, interference by hydrolysing $SiF_6$ e.g. by addition of KCl.

Total $P_2O_5$:

10 ml of bath solution are titrated, after addition of neutral potassium oxalate, from the first to the second stage of $H_3PO_4$, with N/10 NaOH.

1 ml of N/10 NaOH consumed corresponds to 0.71 g/liter of total $P_2O_5$.

Possible errors in the adjustment of the first $H_3PO_4$ stage can be avoided, as indicated in the case of the free $P_2O_5$, by addition of $K_3(Co(CH)_6)$ or KCl, respectively.

In addition to the above-described essential components, other, optional components may also be included in the phosphatising baths. In this regard it is advantageous to employ phosphatising solutions containing up to 0.7 g/liter, especially from 0.2 to 0.5 g/liter Mn. The use of manganese has proved favorable, especially for phosphatising in the low temperature range. Further advantageous embodiments of the invention include using, as a further accelerator, up to 4 g/liter of nitrate and/or using nitro-compounds as an addition of up to 2 g/liter, preferably at least 0.1 g/liter. The organic aromatic nitro-compound to be used, which has proved to be particularly good, is Na m-nitrobenzene sulphonate. However, other representatives of this class of substances, e.g. nitroresorcinol or nitrobenzoic acid, can also be employed. Especially in the joint treatment of zinc and/or aluminum surfaces, but also in the isolated treatment of iron and steel, layer formation can be improved by additions of simple and/or complex fluorides. Moreover, the solutions may contain, for reducing the weight of the phosphate layer, compounds that are known per se for this purpose, such as hydroxycarboxylic acids,—e.g. tartaric acid and citric acid, and polyphosphates,—e.g. tripolyphosphate and hexametaphosphate.

For a given concentration of Zn, Ni, $P_2O_5$, $ClO_3$ and, optionally organic aromatic nitro-compound and Mn and $NO_3$, adjustment of the acid ratio required is essentially effected only with alkali metal ions. Other cations, e.g. calcium copper and cobalt, however, should be present only in minor quantities. Additionally, as has been noted above, the phosphatising solutions should be free of nitrite ions. The treatment of the metal surfaces can be effected by the spraying process, by the flow-coating process and, alternatively, by the dipping process. It can however also be applied by combined working methods, e.g. spraying/dipping/spraying, flow-coating/dipping and the like.

The contact times for the phosphatising solution with the metal surface lie within the customary range and may be, for example, in the case of spraying, from 45 seconds to 3 minutes; in the case of dipping, from 2 to 5 minutes; and in the case of spraying-dipping, 20 seconds' spraying and 3 minutes' dipping. The bath temperatures are typically from 30 to 60 degrees C. The lower the bath temperature, the longer, generally, has to be the contact time.

The coating weight of the phosphate layers, produced by the process according to the invention, generally lies within the range of between 0.8 and 4 grams per square meter. In order to produce particularly thin, fine-crystalline layers, it is desirable to use activators, e.g. based on titanium phosphate, in the pre-rinsing bath or in the last cleaning step before phosphating.

The phosphate layers, produced by the process according to the invention, are suitable, for all types of application of hitherto known phosphate layers. In combination with paint application, the layers cause an exceptionally marked improvement of the stability of the paint film to paint migration under corrosive wear as well as considerable increase in the adhesion of the paint to the metallic substrate. These advantages become particularly apparent in electrophoretic coating, especially in cathodic electrophoretic coating, for which reason the process is preferably applied as preparation for this painting method. The process according to the invention finds practical application e.g. for the phosphatising of automobile bodies.

The process according to the invention will be explained, by way of example and in detail, by means of the following examples.

EXAMPLES 1-6

Sheets of steel, galvanised steel and aluminum, degreased with a mildly alkaline, activating cleaning agent, were treated with the solution of the Examples listed in the following table:

| | EXAMPLES | | | | | |
|---|---|---|---|---|---|---|
| | 1 | 2 | 3 | 4 | 5 | 6 |
| Zn (g/l) | 1.1 | 0.9 | 1.0 | 1.0 | 1.2 | 1.0 |
| Ni (g/l) | 0.9 | 0.45 | 1.2 | 1.0 | 0.6 | 0.8 |
| Mn (g/l) | — | 0.34 | — | — | — | 0.4 |
| $P_2O_5$ (g/l) | 12 | 20 | 15 | 15 | 12 | 14 |
| SNBS+ (g/l) | — | 0.5 | 0.7 | 0.6 | 0.5 | 1 |
| $ClO_3$ (g/l) | 2.5 | 1.8 | 1.5 | 2.5 | 2.0 | 1 |
| $SiF_6$ (g/l) | — | — | — | 1.0 | — | — |
| Zn/Ni | 1:0.8 | 1:0.5 | 1:1.2 | 1:1 | 1:0.5 | 1:0.8 |
| Zn/Mn | — | 1:0.38 | — | — | — | 1:0.4 |
| Zn/Pd $2O_5$ | 1:11 | 1:0.38 | 1:15 | 1:15 | 1:10 | 1:14 |
| free $P_2O_5$++ / total $P_2O_5$ | 0.05:1 | 0.01:1 | 0.03:1 | 0.02:1 | 0.06:1 | 0.007:1 |
| bath temperature (°C.) | 55 | 35 | 50 | 45 | 60 | 32 |
| treatment time (min.) | 3 | 2.5 | 5 | 2 | 1.5 | 2.5 |
| application+++ | spr | spr | di | spr | spr | spr |
| layer weight ($g/m^2$) | | | | | | |
| on steel | 2.0 | 0.9 | 3.5 | 1.8 | 2.1 | 1.0 |
| on Al | 0.1 | 0.1 | 0.1 | 1.2 | 0.1 | 0.1 |
| on galvanised steel | 2.5 | 1.5 | 3.0 | 2.8 | 2.0 | 2.0 |

+sodium m-nitrobenzene sulphonate
++adjusted to the values given by addition of NaOH
+++spr = spraying; di = dipping The thus coated metal sheets were rinsed with water, then rinsed with a second rinsing solution containing chromic acid and subsequently coated with an anodic as well as a cathodic electrophoretic paint. The performance tests, such as salt spray test, condensed moisture test, stone impact test and outdoor weathering, gave very good results.

What is claimed is:

1. A composition for the phosphatising of metals which comprises an aqueous acidic chlorate-containing zinc phosphate solutions which contains:

from 0.5 to 1.5 g/liter Zn
from 0.4 to 1.3 g/liter Ni
from 10 to 26 g/liter $P_2O_5$
from 0.8 to 5 g/liter $ClO_3$ and is free of nitrite and in which the weight ratio of Zn to Ni is adjusted to a value of 1:0.5 to 1.5, that of Zn to $P_2O_5$ to a value of 1:8 to 85 and that of free $P_2O_5$ to total $P_2O_5$ to a value of 0.005 (at about 30 degrees C.) to 0.06 (at about 60 degrees C.):1.

2. The composition of claim 1 in which the weight ratio of free $P_2O_5$ to total $P_2O_5$ for bath temperatures of 30–45 degrees C. is adjusted to a value of 0.005 to 0.03:1, and for bath temperatures of 45–60 degrees C., to a value of 0.03 to 0.06:1.

3. The composition of claim 3 in which the weight ratio of free $P_2O_5$ to total $P_2O_5$ for bath temperatures of 30–45 degrees C. is adjusted to a value of 0.005 to 0.027:1.

4. The composition of claim 2 in which the solution contains from 0.8 to 1.2 g/liter Zn and 1 l to 3 g/liter $ClO_3$.

5. The composition of claim 1 in which the solution also contains up to 0.7 g/liter Mn.

6. The composition of claim 5 in which the solution contains 0.2 to 0.5 g/liter Mn.

7. The composition of claim 1 in which the solution also contains up to 4 g/liter $NO_3$.

8. The composition of claim 1 in which the solution also contains from about 0.1 to 2 g/liter of an aromatic nitro compound.

9. The composition of claim 7 in which the solution also contains from about 0.1 to 2 g/liter of an aromatic nitro compound.

10. A process for phosphatising metal which comprises contacting the metal surface with the composition of claim 1, 2, 3, 4, 5, 6, 7, 8 or 9 for a period of time sufficient to form the desired phosphate coating on the surface, which composition is at a temperature of from about 30 to 60 degrees C.

* * * * *